US006679363B1

(12) United States Patent
Marchant

(10) Patent No.: US 6,679,363 B1
(45) Date of Patent: Jan. 20, 2004

(54) RATCHETING TOOL WITH SPRING-URGED PAWLS AND METHOD

(75) Inventor: Kevin K. Marchant, Kenosha, WI (US)

(73) Assignee: Pilling Weck Incorporated, Horsham, PA (US)

( * ) Notice: Subject to any disclaimer, the term of this patent is extended or adjusted under 35 U.S.C. 154(b) by 21 days.

(21) Appl. No.: 10/124,196

(22) Filed: Apr. 17, 2002

(51) Int. Cl.[7] ..... B25B 13/46
(52) U.S. Cl. ..... 192/43.1; 81/62; 81/63.1
(58) Field of Search ..... 81/62, 63.1; 192/43.1

(56) References Cited

U.S. PATENT DOCUMENTS

| | | | | | |
|---|---|---|---|---|---|
| 277,561 | A | | 5/1883 | Furbish | |
| 371,225 | A | | 11/1887 | Stevens | |
| 791,895 | A | | 6/1905 | Furbish | |
| 1,424,045 | A | * | 7/1922 | Sprague | 74/546 |
| 2,715,955 | A | | 8/1955 | Stone | |
| 2,744,432 | A | | 5/1956 | Rueb | |
| 3,061,061 | A | | 11/1962 | Browning | |
| 3,356,117 | A | | 12/1967 | Wagner | |
| 3,783,703 | A | | 1/1974 | Trimble | |
| 4,290,328 | A | | 9/1981 | Clark | |
| 4,466,523 | A | | 8/1984 | De Carolis | |
| 5,613,585 | A | | 3/1997 | Tiede | |
| 5,619,891 | A | * | 4/1997 | Tiede | 81/62 |
| 5,848,680 | A | | 12/1998 | Rinner | |
| 5,873,288 | A | * | 2/1999 | Gauthier et al. | 81/62 |
| 5,943,755 | A | | 8/1999 | Gauthier | |
| 6,282,990 | B1 | * | 9/2001 | Miner | 81/62 |

FOREIGN PATENT DOCUMENTS

| | | |
|---|---|---|
| FR | 775487 | 10/1934 |
| GB | 584232 | 1/1947 |

* cited by examiner

*Primary Examiner*—Rodney H. Bonck
*Assistant Examiner*—Eric M. Williams
(74) *Attorney, Agent, or Firm*—Arthur J. Hansmann

(57) ABSTRACT

A ratcheting tool, such as a screwdriver, having a handle with gear and two pawls movable into selective driving engagement with the gear by movement of an actuator on the handle. A spring is anchored on the handle and extends into contact with the two pawls for urging the pawls into engagemnt with the gear.

20 Claims, 4 Drawing Sheets

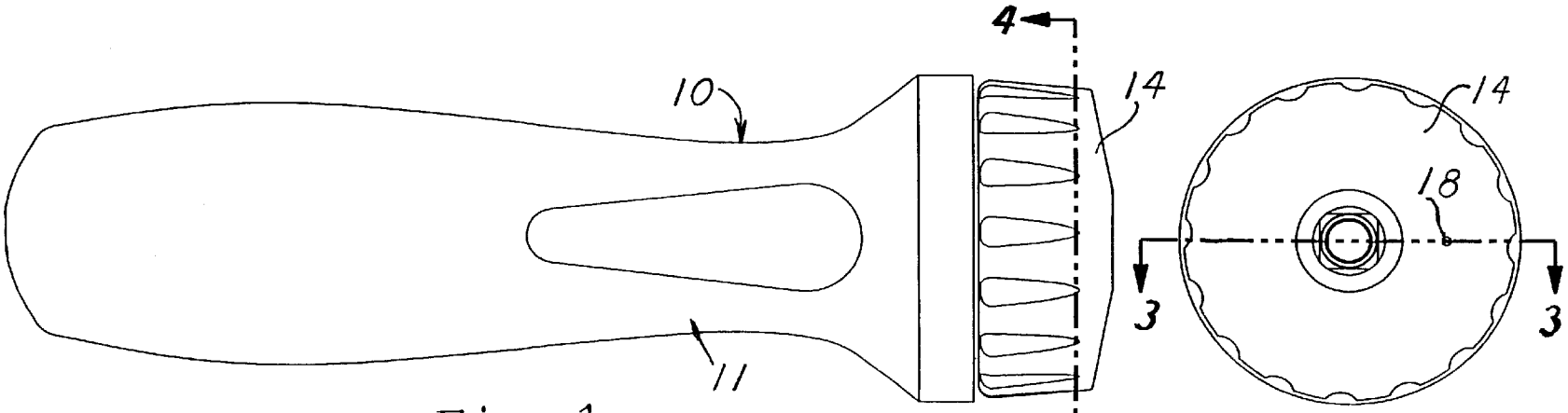
Fig. 2
Fig. 1
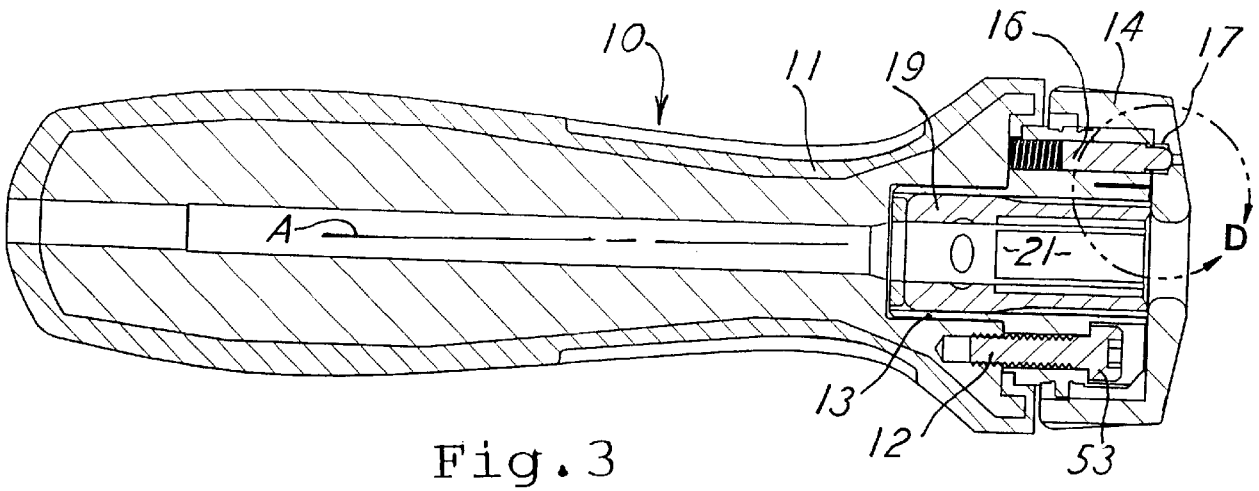
Fig. 3

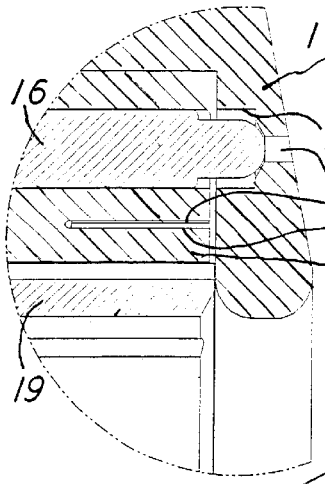
Fig.7
Fig.4
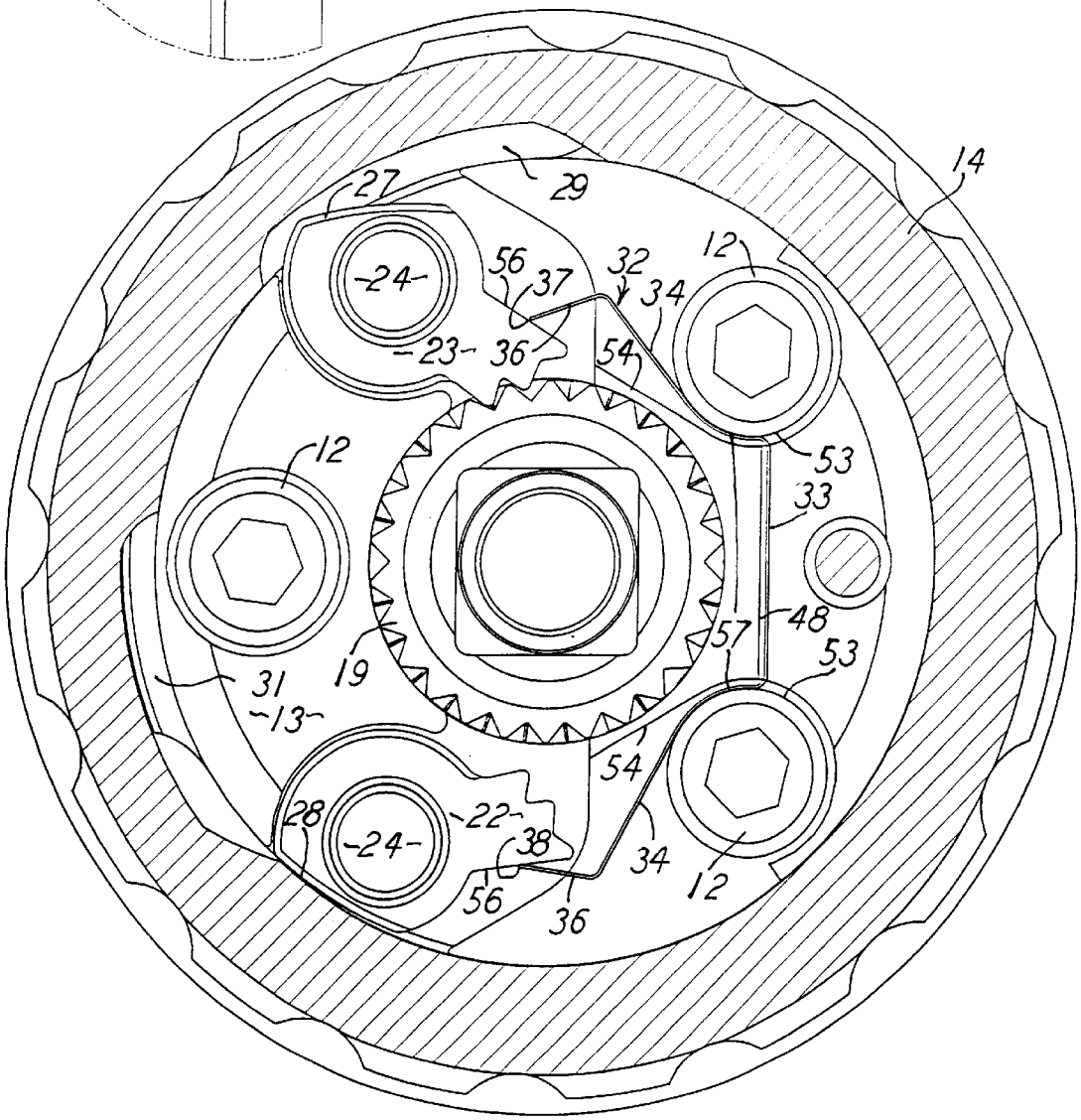

Fig.8
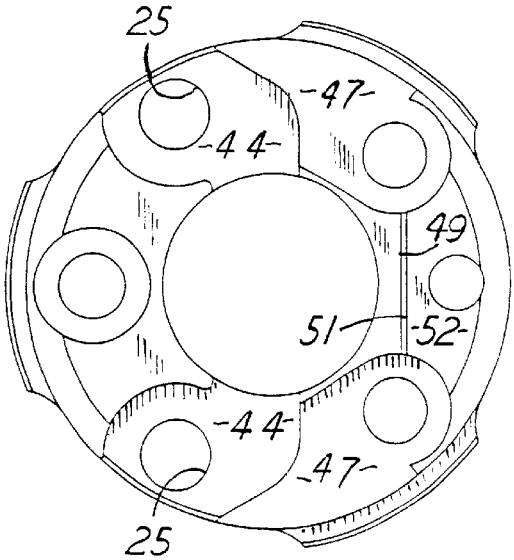
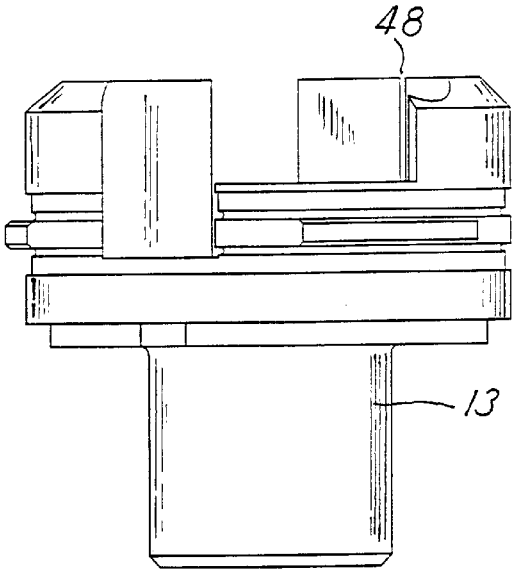
Fig.9
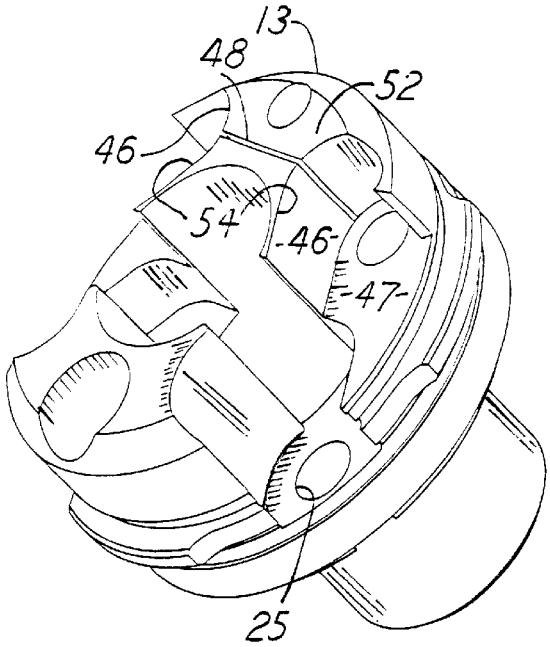
Fig.10

RATCHETING TOOL WITH SPRING-URGED PAWLS AND METHOD

This invention pertains to a ratcheting tool with spring-urged pawls and method, and, more particularly, it pertains to a ratcheting tool having a handle with a spring anchored thereto for actuating two pawls.

BACKGROUND OF THE INVENTION

Ratcheting tools are well known in the prior art, and they are known to include pivotal pawls which are urged by a spring or springs into driving engagement with a gear. The pawls are known to be both slidably and pivotally movable into and out of gear engagement.

The present invention improves upon the prior art by stabilizing the spring which acts upon the pawl. That is, in the prior art, there is known a single for two pivotal pawls, but the spring is at least somewhat free to move or wander about its location which is otherwise intended to be the anchor for the spring relative to the tool or mechanism handle.

The present invention is particularly useful in ratcheting mechanisms having two pivotal pawls which are controlled by a spring. In that arrangement, it is important to anchor the spring so that its application of spring-force upon the pawls can be at optimum consistency and efficiency.

Therefore, the spring should be secured in a fixed position on the tool and not be susceptible to deviating from its intended anchored position. Again, compared to the arrangements of springs of the prior art, when those springs are forcing against a pawl, those springs can slide relative to their tool handles. That undesirable feature is particularly true where the spring is intended to be supported against a curved portion of the handle. The pawl force against the spring causes the spring to slide along that curved handle portion which is otherwise intended to fixedly anchor the spring and support it against wandering or sliding relative to the handle and the pawl.

In the present invention, there can be two pivotally mounted pawls and one spring for urging those two pawls into engagement with a gear. The spring is anchored in the tool handle to secure the spring against wandering even though the spring is under force against the pawls.

Also, that inventive concept can be applied by having a spring for one pawl, but, again, the spring would be anchored against wandering. In the preferred embodiment of this invention, there is a U-shaped spring with two ends in respective contact with two pawls, and the spring has an intermediate portion which is stabilized relative to the tool handle.

In the method aspect of this invention, the tool handle is provided with a slit and the spring is provided with an intermediate portion which matches the shape of the slit. The spring intermediate portion is positioned in the slit and the spring free ends extend into contact with two pawls for actuating the two pawls. In that operational arrangement, the spring is anchored relative to the tool handle and is held against wandering in the housing or handle.

Other objects and advantages will be apparent upon reading the following description in light of the accompanying drawings.

BRIEF DESCRIPTION OF THE DRAWINGS

FIG. 1 is a side elevational view of a ratcheting screwdriver utilizing this invention.

FIG. 2 is an end elevational view of FIG. 1.

FIG. 3 is a sectional view taken on the plane designated by the section line 3—3 of FIG. 2.

FIG. 4 is an enlarged sectional view taken on the plane designated by the line 4—4 of FIG. 1.

FIG. 7 is an enlarged sectional view of a portion of FIG. 3 as enclosed by the circle designated D in FIG. 3.

FIG. 8 is a reduced view of FIG. 4 with parts removed.

FIG. 9 is a side elevational view of FIG. 8.

FIG. 10 is a perspective view of FIG. 9.

DETAILED DESCRIPTION OF A PREFERRED EMBODIMENT AND METHOD

Figure 5:
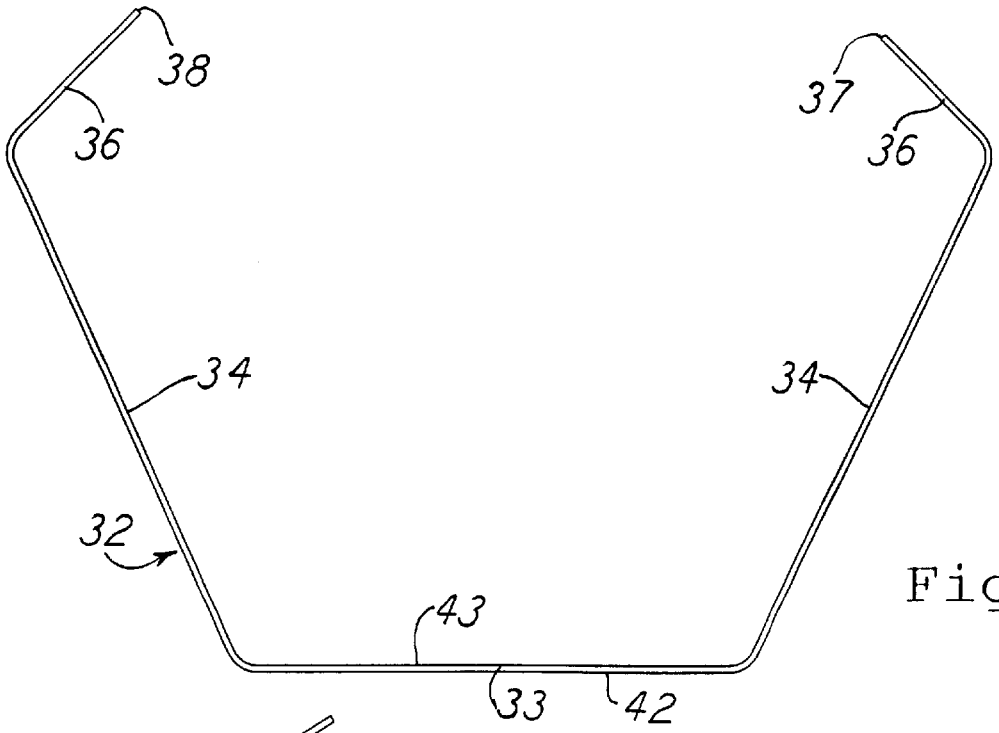
FIG. 5 is an enlarged free-body end elevational view of the spring of this invention as seen in FIG. 4.

This invention is particularly useful in a ratcheting screwdriver, and is therefore shown and herein described in that context. It will be understood that the invention applies to a ratcheting tool. U.S. Pat. Nos. 5,613,585 and 5,943,755 disclose ratcheting mechanisms which utilize springs for activating pawls into driving relationship with a gear which in turn drives a screwdriver bit or the like. In the first patent, only one spring is needed to control the two pawls, and, in both patents, the spring is guided by the tool handle. The present invention differs from those two patents in respects claimed herein.

FIGS. 1, 2, and 3 show a screwdriver 10 having an elongated handle 11. Affixed to the handle 11 by means of screws 12 is an insert 13 which is shown in all views except 1 and 2, and is particularly shown in FIGS. 8, 9, and 10. So handle 11 and insert 13 can be hand rotated together about the longitudinal axis A, such as for driving a screw (unshown). It should be considered that the handle 11 and the insert 13 are the housing of the tool.

An actuator cap 14 is rotatably mounted on the insert 13 to be limitably rotatable relative to the handle 11 and insert 13 and about the axis A. The particular assembly shown in this instance is as shown in U.S. Pat. No. 5,848,680 and the assembly is that of a bayonet connection which has a bayonet type projection 16 on the insert 13 and a mating bayonet projection (unshown) on the cap 14. With the respective projections positioned to overlap each other, the cap 14 is bayonet-engaged with the insert 13 by relative rotation therebetween in the usual bayonet engagement. Then the cap 14 is limited in further rotation about axis A and relative to the insert 13, and that limitation is by a spring-loaded pin 16 which rides in a groove 17 in the cap 14 to limit the rotation of the cap 14. So the bayonet connection can not be released without releasing the pin 16 from the groove 17, such as by unseating the pin 16 from its groove 17 by depressing the pin 16 when the pin 16 is accessed through an access hole 18 in the cap 14, and that is when the hole 18 is aligned with the pin 16. The disclosure of U.S. Pat. No. 5,848,680 is incorporated herein for any further disclosure required on that relationship.

Another portion of general interest is that of a gear 19 which is freely rotatable in the insert 13 and about the axis A. It will be understood the gear has a central opening 21 which receives a tool bit, such as a screwdriver bit (unshown). As hereinafter explained, gear 18 can be rotated to in turn rotate the bit held therein and thereby perform the screwdriver work desired.

Two pawls 22 and 23 are pivotally mounted on the insert 13 on pivot posts 24 at respective ones of two inserts holes 25 as seen in FIGS. 8 and 10. The pawls 22 and 23 have teeth 26 which engage teeth 27 on the gear 19 for rotating the gear, as desired. Of course the tooth engagement is such that there is a ratcheting effect, in the manner such as that disclosed in U.S. Pat. 5,943,755, which disclosure is incorporated herein.

Pawls 22 and 23 are pivoted out of engagement with the gear 19 by having mutually engageable surfaces 27 and 28 respectively on the pawls and the cap 14.

Thus, when the cap 14 is rotated to the FIG. 4 position, then the pawl 22 is pivoted to be disengaged from the gear 19, as shown. Also, at that FIG. 4 position of cap rotation, the pawl 23 is in gear engagement because the cap 14 has a recess 29 which receives a portion of the pawl 23 to allow the pawl 23 to pivot into engagement with the gear 19, as shown. Of course, the relationship between the cap 14 and the two pawls 22 and 23 is the same for both pawls, so both pawls engage and can disengage relative to the gear 19 and in response to rotation of the cap 14 on the housing. Also the cap recess 29, and its recess 31, are arranged to have both pawls 22 and 23 in gear-engaged positions at the same time.

The disclosure of the pawls, the cap and the gear are also as disclosed in U.S. Pat. No. 5,943,755.

Figure 6:
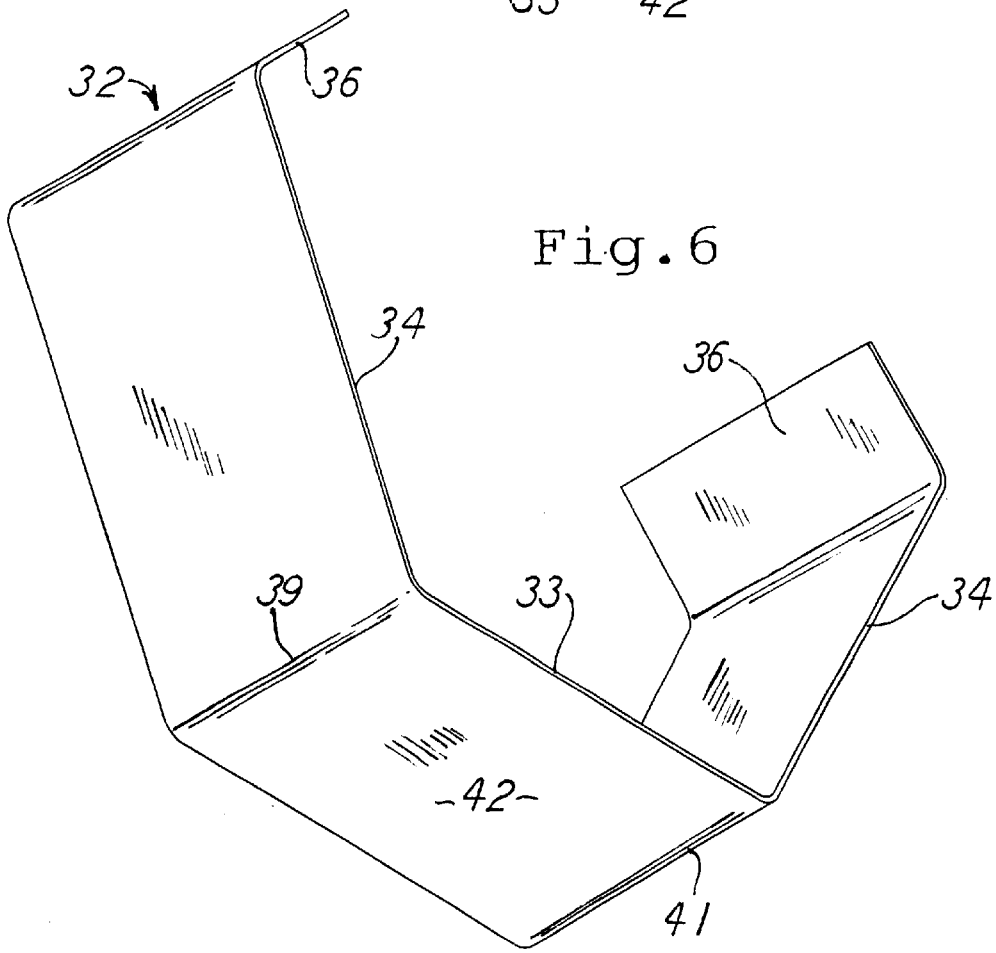
FIG. 6 is a perspective view of the spring of FIG. 5.

This invention is concerned with spring means for urging the two pawls 22 and 23 into tooth engagement with the gear 19, such as seen with the pawl 23 in FIG. 4. In the preferred embodiment shown herein, there is a U-shaped spring 32 anchored in the tool handle. FIGS. 5 and 6 show the free body view of the spring 32, that is, they show the shape of the spring 32 when it is free of the forces acting thereon and when in its unassembled position with the handle.

It will be seen that the spring 32 has an intermediate portion 33, two extending leg portions 34, and two terminal ends 36, all being continuous along the length of the spring. The spring 32 is a flat-type spring having its length extending from its straight edge 37 to its other straight edge 38 and thereby defining the length of the spring 32. The intermediate portion 33 is straight or planar, and FIG. 5 shows the U-shape in side view. The intermediate portion 33 extends between the corners 39 and 41 which define the width of the spring 32 along the corners 39 and 41. The thickness of the spring 32 is relative thin, and the spring can be of a flexible, tempered steel material. In the free-body position as seen in FIG. 5, there is a slightly greater than ninety degree inclusive angulation between the legs 34 and the intermediate portion 33 and the terminal ends 36. In all, the intermediate portion 33 has the shape of a rectangle in its bottom view which can be seen in FIG. 6, and it there presents a flat rectangular surface 42 on what is the outside of the spring 32 and an identical flat rectangular surface 43 on what is the inside of the spring 32.

As will be understood later, the exact shape of the spring 32 need not be as shown and described herein in this preferred embodiment.

The insert 13 has two relieves or pockets 44 and two pockets 46, for respectively receiving the pawls and the attaching screws 12, as seen in FIGS. 4, 8, and 10. The pockets 46 have end walls 47.

A slit or groove 48 is in the insert 13, and it is shown to be straight or planar and is defined by two spaced-apart and parallel surfaces 49 and 51 on the insert 13. The slit extends from the insert surface 52 which is adjacent the cap 14, to the insert surface 47. Thus the slit 48 presents a pocket of a rectangular shape between the surfaces or walls 49 and 51 and it extends to adjacent the heads 53 of the connecting screws 12, as seen in FIGS. 3 and 4.

The slit 48 extends tangentially relative to the tool longitudinal axis A, that extent is the same as that of the spring intermediate portion 33. FIG. 4 shows that the spring portion 33 is fully received in the slit to be snug therein and fully constrained therein against movement in all directions except along the axial direction of axis A and upwardly, as seen in FIG. 4, for assembly and disassembly, and the spring is then restrained by the cap 14, as seen in FIG. 7. Thus the handle assembly holds the spring 32 against movement or wandering relative to the handle assembly.

FIG. 4 further shows that the spring legs 34 abut the screws 12 and therefore curve about the screws 12. The insert 13 has two walls 54 adjacent the spring legs 34, which, along with the screw heads 53, confine the spring 32 on the handle.

FIG. 4 further shows that the spring ends 37 and 38 respectively abut the pawls 23 and 22 such that the spring 32 urges the pawls toward the gear 19 and thus into tooth engagement with the gear.

Even without the confinement of the screw heads 12, because the slit 48 and the spring portion 33 are not arcuate in a shape centered about the axis or the location of the pawls, the spring 32 will not wander from its mounted position when it is under force from the pawls, such as with pawl 22 in the FIG. 4 position. That pawl force will simply press the spring portion 32 against the wall or walls 49 and 51 which will restrained the spring. Where the screw heads 12 are employed, the spring shape is not critical and the pawl force will simply press the spring leg 34 against the screw head 12, and force the spring portion 33 against either one of the walls 49 and 51. In all events, the spring 32 will not wander on the insert 13 and it will therefore always be in optimum position for uniformly forcing on the pawls. The pawls themselves have flat surfaces 56 which present a slidable surface for the self-adjustment of the spring ends 37 and 38 to slidably engage the pawls, as desired.

Where the screws 12 are employed for abutting the spring 32, the force on the spring 32 from the pawls is in the direction to force the spring against the screw 32. In that instance, the shape of the slit 48 is not critical. Where the screws 32 are not in abutment with the spring 32, such as where the screws are not so employed, the spring should be with its flat portion and not be arcuately shaped with the center of curvature located on or near axis A or at or near the pawls or their environs.

It will also be seen that the two pawls 22 and 23 and the slit 48 are relatively disposed in the axial view of FIG. 4 to be substantially equally spaced around the axis A. Also, spring 32, because of its contact with the screws 12, is pre-stressed in that it bends around the screws and along its legs 34. Therefore, there is enhanced spring force available for application on the pawls. Still, further, when a pawl is in the disengaged position, as seen with pawl 22, there is greater spring force applicable throughout the spring 32 to thereby further force on the pawl 23. The screws 12 present handle surfaces 57 for guiding the spring and bending the spring legs 34, and the legs are snugly disposed between the surfaces 54 and 57. Also, the spring 32, when in its assembled position of FIG. 4, has a shape different from its free-body shape. Thus, when assembled, the angles between the portion 33 and the legs 34 are substantially a right angle compared to the obtuse angle of FIG. 5.

While a description of a preferred embodiment is in the foregoing, the method, as claimed herein, is also revealed to one skilled in the art and the method is also disclosed in that description. Changes can be made in the tool and the method in view of the context of this description and, the scope of the invention should be construed by the claims.

What is claimed is:

1. In a ratcheting tool of the type having a handle with a longitudinal axis, a gear rotatably disposed on said handle and rotatable about said axis, two pawls disposed on said handle and being movable toward and away relative to said gear and being arranged to be in driving engagement with said gear upon movement toward said gear, and an actuator movably mounted on said handle and being arranged to be in contact with said pawls for moving said pawls away from said gear and thereby out of engagement with said gear, the improvement comprising:

a spring having a length with two terminal ends and an intermediate portion, said handle having two spaced-apart walls which are spaced from said axis and present a planarly extending pocket therebetween and said spring intermediate portion being movably confined in said pocket by said walls, and said two terminal ends extending from said intermediate portion and into respective contact with said pawls for urging said pawls into engagement with said gear.

2. The ratcheting tool as claimed in claim 1, wherein:

said intermediate portion along said length of said spring and said two walls are planar in their respective extents and said intermediate portion is confined in said pocket relative to movement toward and away from said pawls.

3. The ratcheting tool as claimed in claim 1, wherein:

said spring intermediate portion has a constant thickness thereon, and said two spaced-apart walls are parallel to each other and are spaced apart an amount only slightly more than said thickness of said spring for snugly receiving said spring in the confinement thereof.

4. The ratcheting tool as claimed in claim 1, wherein:

said pocket is disposed in said handle at a location equi-distant from both said two pawls.

5. The ratcheting tool as claimed in claim 1, wherein:

said two pawls are radially spaced from said axis and are on a circle coaxial with said axis, said pocket being located intermediate said pawls, and said two pawls and said pocket being at least approximately equally spaced from each other.

6. The ratcheting tool as claimed in claim 1, wherein:

said spring has two leg portions extending from said intermediate portion to respective ones of said terminal ends, and said walls being free of any curvature facing toward said pawls to thereby stabilize said spring against movement toward and away relative to said pawls.

7. The ratcheting tool as claimed in claim 6, wherein:

said handle has two spaced-apart surfaces fixed thereon, and said spring two leg portions are disposed to respectively abut said handle surfaces and thereby place said spring under spring bending tension to thereby enhance both the confinement of said spring and the urging of said spring into contact with said pawls.

8. In a ratcheting tool of the type having a handle, a gear rotatably disposed on said handle, two pawls disposed in said handle and being movable toward and away relative to said gear and being arranged to be in driving engagement with said gear upon movement toward said gear, and an actuator movably mounted on said handle and being arranged to be, drivingly related to said pawls for moving said pawls away from said gear and thereby out of engagement with said gear, the improvement comprising:

a spring having a length with two terminal ends and an intermediate portion, said handle having two spaced apart walls free of any curvature and said walls and additional means on said handle engagable with said intermediate portion to movably confine said intermediate portion toward and away relative to said gear, means on said handle for restraining said spring against movement toward said pawls, and said two terminal ends extending from said intermediate portion and into contact with respective ones of said pawls for urging said pawls into engagement with said gear.

9. The ratcheting tool as claimed in claim 8, wherein:

said intermediate portion and said walls are planar in their respective extents.

10. The ratcheting tool as claimed in claim 8, wherein:

said handle has a longitudinal axis and said gear is rotatable about said axis, said two pawls are radially spaced from said axis and are disposed on a circle coaxial with said axis, and said two pawls and said walls are all three at least approximately equally spaced from each other along said circle.

11. The ratcheting tool as claimed in claim 8, including:

said handle has two surfaces fixed thereon, and said spring has two leg portions extending from said intermediate portion to respective ones of said terminal ends and said leg portions are disposed to respectively abut said handle surfaces to place said spring under spring tension and thereby enhance both the confinement of said spring and the urging of said spring into contact with said pawls.

12. In a ratcheting tool of the type having a handle with a longitudinal axis, a gear rotatably disposed on said handle along said axis for driving a tool bit, two pawls disposed in said handle and being movable toward and away relative to said gear and being arranged to be in driving engagement with said gear upon movement toward said gear, and an actuator movably mounted on said handle and being arranged to move said pawls away from said gear and thereby out of engagement with said gear, the improvement comprising:

a spring having a length with two terminal ends and an intermediate portion, said handle having two co-extensive walls free of any curvature and said walls defining a slot between said walls and said intermediate portion of said spring being movably confined in said slot against movement toward and away relative to said pawls, and said two terminal ends extending from said intermediate portion and into contact with respective ones of said pawls for urging said pawls into engagement with said gear.

13. The ratcheting tool as claimed in claim 12, wherein:

there is a circle concentric to said axis and said slot extends tangentially relative to said circle.

14. The ratcheting tool as claimed in claim 13, wherein:

said slot is disposed in said handle at a location equidistant from both said two pawls.

15. The ratcheting tool as claimed in claim 12, wherein:

said spring has two leg portions extending from said intermediate portion to respective ones of said terminal ends, said handle has had two spaced-apart surfaces fixed thereon, and said spring two leg portions are disposed to respectively abut said handle surfaces and thereby place said spring under spring-bending tension to thereby enhance both the confinement of said spring in said slot and the urging of said spring into contact with said pawls.

16. A method of securing a spring in a ratcheting tool having a handle with an axis, a gear, and two pawls movably engagable with said gear, the improvement comprising the steps of:

forming an elongated pocket in said handle and spaced from said axis and defined by two co-extensive and planar walls, forming a spring with a length having two terminal ends and an intermediate portion between said ends, said pocket and said intermediate portion having a similar shape and with said intermediate portion snugly disposed in said pocket to be anchored relative to said handle, and positioning said spring two terminal ends in respective contact with said two pawls for urging said pawls into engagement with said gear.

17. The method of securing a spring as claimed in claim 16, including the steps of:

forming said spring in a shape to thereby have a leg extending between said intermediate portion and each of said terminal ends, and forming two surfaces on said handle and positioning each said leg in abutment with a respective one of said surfaces for enhancing both the anchoring and the spring tension of said spring.

18. The method of securing a spring as claimed in claim 16, including the steps of:

having said spring in a shape having two legs extending from said intermediate portion, and placing a bend in each of said two legs in a direction to enhance the spring force transmitted by said spring on said pawls.

19. The method of securing a spring as claimed in claim 16, including the step of:

presenting said pocket in the shape of a narrow and elongated slit in said handle.

20. The method of securing a spring as claimed in claim 16, including the step of:

placing said spring onto said handle by bending said two legs and thereby place a spring stress in said spring and maintaining that stress in said spring in the assembled position with said handle.

* * * * *